US006338294B1

(12) United States Patent
Wagner et al.

(10) Patent No.: US 6,338,294 B1
(45) Date of Patent: Jan. 15, 2002

(54) LINEAR DRIVE

(75) Inventors: Albrecht Wagner, Winterbach; Eric Angué, Stuttgart, both of (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 09/551,095

(22) Filed: Apr. 18, 2000

Related U.S. Application Data

(63) Continuation of application No. PCT/EP99/06824, filed on Sep. 15, 1999.

(30) Foreign Application Priority Data

Sep. 30, 1998 (DE) ..... 298 17 441 U

(51) Int. Cl.[7] ..... F01B 29/00
(52) U.S. Cl. ..... 92/88
(58) Field of Search ..... 92/13.41, 13.5, 92/13.7, 88

(56) References Cited

U.S. PATENT DOCUMENTS 4,252,285 A * 2/1981 Hammond et al. ..... 92/88
4,685,383 A * 8/1987 Ruchser ..... 92/88
4,733,604 A * 3/1988 Lipinski ..... 92/88
4,838,147 A * 6/1989 Grishchenko ..... 92/88
4,991,494 A * 2/1991 Migliori ..... 92/88
5,555,789 A 9/1996 Rosengren et al.
6,196,110 B1 * 3/2001 Angue ..... 92/88

FOREIGN PATENT DOCUMENTS

| | | |
|---|---|---|
| DE | 297 06 493 U1 | 8/1997 |
| EP | 0 113 790 A1 | 7/1984 |
| EP | 0 713 748 A1 | 5/1996 |

* cited by examiner

*Primary Examiner*—Edward K. Look
*Assistant Examiner*—Igor Kershteyn
(74) *Attorney, Agent, or Firm*—Hoffmann & Baron, LLP

(57) ABSTRACT

A linear drive comprising an elongated housing, whose interior space contains a drive part adapted to move in the longitudinal direction. The housing furthermore has a longitudinal slot, which is provided with a sealing tape extending in the interior space, said tape being lifted clear of the longitudinal slot by at least one guide face arrangement at the drive part. A guided slide is arranged outside the interior space, such slide being coupled with the drive part extending through the longitudinal slot. The guide face arrangement is provided on the drive part and furthermore the part of the entraining member fitting into the receiving socket is in the form of an entraining finger having a free end thereof directed toward the sealing tape.

18 Claims, 3 Drawing Sheets

LINEAR DRIVE

This application is a continuation of International Application No. PCT/EP99/06824, filed on Sep. 15, 1999.

BACKGROUND OF THE INVENTION

The invention relates to a linear drive comprising an elongated housing, whose interior space contains a drive part adapted to move in the longitudinal direction and furthermore has a longitudinal slot, which is provided with a sealing tape extending in the interior space, said tape being lifted clear of the longitudinal slot at the drive part by at least one guide face arrangement, said face arrangement facing away from said longitudinal slot, a longitudinal guide which is arranged outside the interior space and extends in parallelism to the same, a slide guided on the longitudinal guide for movement in the longitudinal direction, and an entraining member, which is secured to the slide, extends through the longitudinal slot to fit into a receiving socket open toward the longitudinal side of the drive part where it bears on axially aligned force transmitting faces.

THE PRIOR ART

A linear drive of this type is for instance disclosed in the European patent publication 0 113 790 B1. This known linear drive is of the fluid operated type and comprises a housing with an elongated interior space, which is open through a longitudinal slot to the outside. A drive part, in the form of a piston, running in the longitudinal direction in the interior space is connected by means of an entraining member, which extends through the slot, with a slide running on an external longitudinal guide. For sealing off the interior space the inner opening of the longitudinal slot is provided with a sealing tape, which is moved clear of the longitudinal slot by a guide face arrangement at the drive part in order to render it possible for the entraining member to extend through the slot. The entraining member itself is fixedly secured to the slide and a forked terminal part thereof extends into a receiving socket defined between two piston parts of the drive part, it being fitted around a central section of the piston and simultaneously bearing against axially aligned faces on the piston parts in order to ensure a coupling connection with minimum play between the piston and the entraining member.

The particular design of the known linear drive entails relatively elaborate production and assembly. Furthermore, the slide may only be dismounted in any necessary serving operations, for example for the purpose of replacement of components of the longitudinal guide, if the housing is taken to pieces with the result that the linear drive is out of unservice for some time.

SHORT SUMMARY OF THE INVENTION

Accordingly one object of the present invention is to provide a linear drive of the initially described type which is more particularly characterized by a simplification of production and assembly of the slide-entrainment member unit.

In order to achieve these and/or other objects appearing from the present specification, claims and drawings, in the present invention the guide face arrangement is provided on the drive part and furthermore the part of the entraining member fitting into the receiving socket is in the form of an entraining finger having a free end thereof directed toward the sealing tape, such finger terminating short of the sealing tape section moved clear of the longitudinal slot.

Whereas in the prior art the guide face arrangement for the sealing tape is located on the entraining member, it is now a component of the drive part so that the entraining member may be coupled with the drive part without involving complex handling and manipulation of the sealing tape. In this connection there is a further simplification of assembly owing to the fact that the entraining member does not fit around the drive part on the radial side facing away from the longitudinal slot, and in fact has a simple entraining finger fitting into the associated receiving socket of the drive part and comes to an end short of the sealing tape section moved clear of the longitudinal slot by the guide face arrangement. Collisions between the entraining member and the sealing tape are now not possible and the necessary coupling between the entraining finger of the entraining member and the drive part may be ensured as a rule by simple plugging into and through the longitudinal slot. It is in this manner that it is possible for the slide and entraining member unit to be coupled in a relatively simple fashion with the drive part even when the sealing tape has already been fitted and fitting of the slide and the entraining member on the one hand and of the drive part and the sealing tape on the other hand may be performed separately without any trouble provided there is a suitable design. This furthermore facilitates any decoupling of the slide from the drive part which may be necessary for servicing purposes, since for this purpose the drive unit comprising the housing, the drive part and the sealing tape does not have to be taken apart.

Although the German patent publication 29,706,493.2 (utility model) discloses the feature of providing a guide face arrangement on the drive part itself serving for deflecting the sealing tape from the longitudinal slot, here the entraining member is an integral component of the drive part, something which necessitates a mutually separate manufacture of the drive part and of the entraining member.

Advantageous further developments of the invention are indicated in the claims.

In the case of one convenient form of the linear drive the drive possesses a guide channel defining at least one part of the guide face arrangement and having the sealing tape extending through it, and which extends more particularly with a clearance past the receiving socket on the side facing away from the longitudinal slot. In this respect a partition may be provided between the receiving socket and the guide channel, said partition preventing in all cases direct contact between the entraining finger and the sealing tape.

Since the entraining finger only overlaps or occupies a small part of the cross section of the drive part, it is more especially possible to have extremely compact transverse dimensions. In this connection it is quite an advantage in addition if the entraining finger, which preferably extends radially in relation to the longitudinally extending center axis of the drive part, ends short of such center axis.

The receiving socket itself may be constituted by groove-like recess in the drive part, which only extends over part of the periphery of the drive part, and for example is cut into the drive part like a notch or an incision.

In accordance with a further convenient development of the linear drive the entraining finger cooperates with the force transmitting faces via an elastomeric intermediate layer. It is in this manner that irrespectively of manufacturing inaccuracies it is possible at all times to ensure play-free contact between the entraining finger and the force transmitting faces in the axial direction of movement of the drive part and of the slide. Furthermore, these measures serve to allow a small degree of relative movement between the entraining finger and the drive part, such relative motion rendering possible a certain degree of decoupling and preventing jamming if the paths of movement of the drive part and of the slide are not exactly parallel to one another.

The entraining member is preferably attached in a releasable manner on the slide. This measure simplifies coupling between the entraining member and the drive part when the slide is already fitted to the longitudinal guide.

It is more particularly possible to make such a provision that the entraining member is mounted in such an adjustable fashion on the slide that in the case of a slide borne on the longitudinal guide it can be selectively positioned either in an extended setting fitting through the longitudinal slot into the receiving socket and a retracted setting outside the longitudinal slot. In this case there is the possibility of positioning the slide at the same axial level as the drive part when the entraining member is in the retracted setting and then by moving out the entraining member, more especially by hand, of plugging its entraining finger through the longitudinal slot into the receiving socket. By the reverse movement it is possible for the entraining member and accordingly the slide as well to be decoupled from the drive part again, for instance in order to perform any servicing operations which may be necessary.

In the case of a preferred modified embodiment of the linear drive, which more particularly renders possible a flat or low configuration, the longitudinal guide is located on a support plate connected with the housing and is opposite to that longitudinal side of the housing, which has the longitudinal slot. In this case the support plate is more particularly connected integrally with the housing so that the unit comprising the housing and the support plate may be produced economically as an extrusion, which is more especially made of aluminum material.

In principle it is possible for the linear drive for example to be so designed that its drive part may be caused to perform a linear movement by an electric motor. In this case the drive part could run on a lead screw extending in the interior space of the housing and coupled with an electric motor. However in most cases the linear drive will be designed as a fluid power unit, the drive part being constituted by a piston, which divides the interior space into two working spaces adapted to receive drive fluid, the linear motion being caused by suitably metered supply and/or removal of a drive fluid to and, respectively, from the working spaces. As a drive fluid compressed air is more particularly employed.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
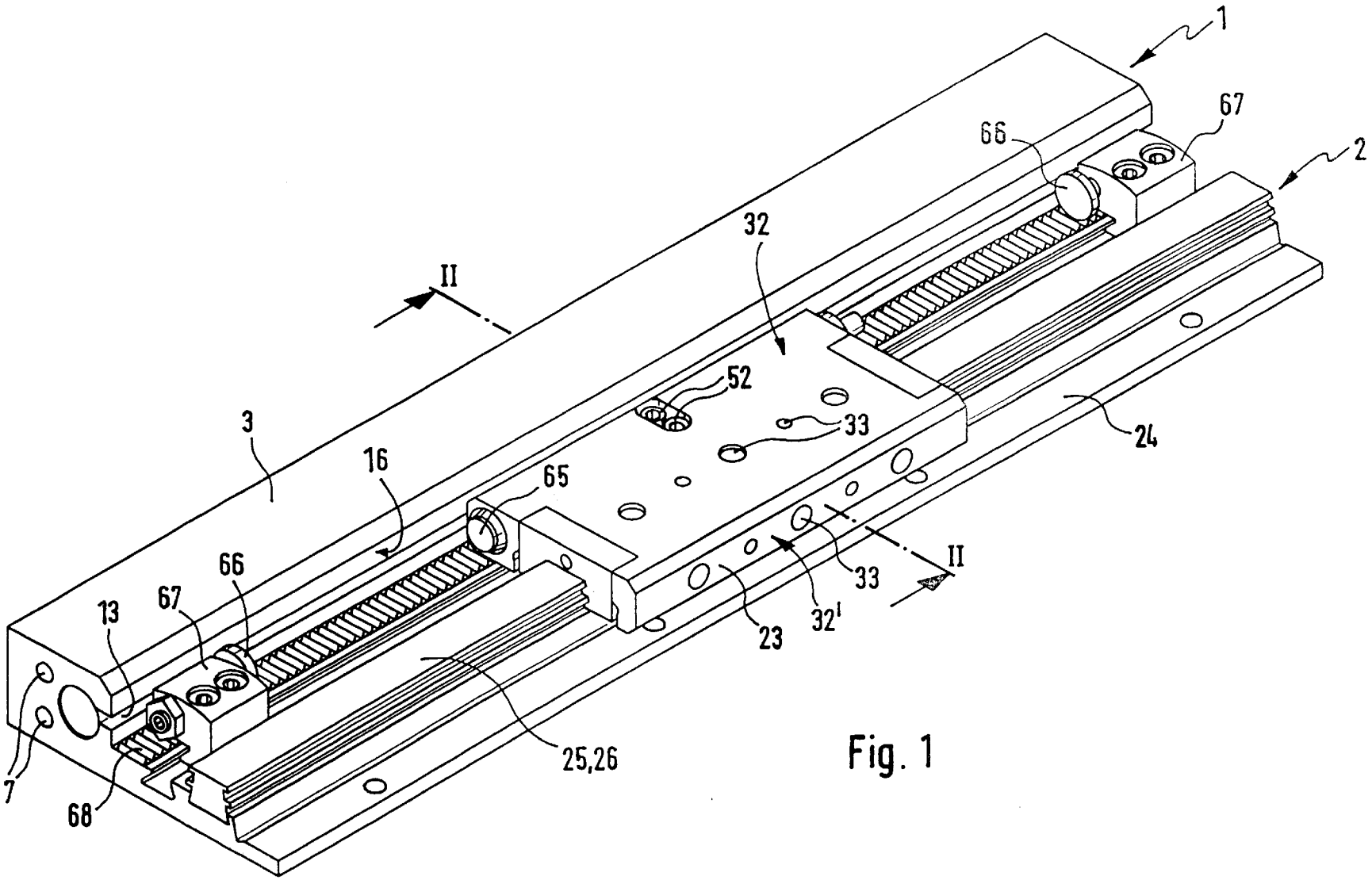
FIG. 1 shows a preferred first form of the linear drive of the invention in a perspective view.

The linear drives given as examples here each possess a drive unit 1 and a guide unit 2 arranged adjacent to it, both having an elongated configuration, same being parallel to other.

The drive unit 1 possesses a longitudinal housing 3, which in the interior defines an interior cylindrical space 5 extending in the longitudinal direction 4. In the interior space 5 a drive part 6 is arranged able to move in the longitudinal direction 4.

By the application of operating forces it is possible for the drive part 6 to be moved linearly in the interior space 5 in the one or the other direction. In the working example the operating forces in the working embodiment are fluid forces, which are supplied by the intermediary of an operating fluid, more particularly in the form of compressed air, which may be let in via fluid ducts 7 extending in the housing 3 as required, the interior space 5 being divided up into such spaces by the drive part 6. In the working example the drive part consequently constitutes a piston, which possesses sealing means 12 and 12' cooperating with the wall of the interior space 5, such sealing means 12 being responsible for a fluid-tight separation of the working spaces 8 and 8' lying axially on either side of the drive part 6.

The housing 3 possesses a slot 13 extending in the longitudinal direction 4. The slot is at one position of the periphery of the interior space 5 and has an elongated inner opening 14 adjacent to the interior space and an outer opening 15, which is also elongated, adjacent to the outer face of the housing 3. The slot 13 therefore extends through the wall, which delimits the interior space peripherally, of the housing 3 at a longitudinal side 16 thereof. The outline of the housing 3 may furthermore be rectangular in cross section, the said longitudinal side 16 being formed by one of the four outer faces of the housing 3.

In order to prevent escape of working fluid from the interior space 5 via the slot 13, the inner opening 14 of the slot 13 has a sealing tape 17, arranged in the interior space 5, such tape 17 extending in the longitudinal direction 4. By suitable means, which are not illustrated, the tape is secured at the axial ends of the interior space 5 and adjacent to the working spaces 8 and 8' is in engagement with sealing faces 18 flanking the slot 13 adjacent to inner opening 14, such sealing faces being provided on the housing.

The drive part 6 possesses first and second axially spaced sealing means 12 and 12' which are more especially associated with its two terminal portions. Such sealing means are responsible for sealing off the working spaces 8 and 8' from the drive part 6. In the zone of the drive part 6 between the sealing means 12 and 12' the sealing tape 17 is lifted clear radially inward toward the interior space 5 from the slot. The lifted section of the sealing tape is marked by reference numeral 22 in the drawing. This measure means that the drive part 6 may be kinematically coupled with a slide 23, forming part of the guide unit 2, by means of an entraining member 21, such member extending through the slot 21 athwart the longitudinal direction.

In the working embodiment the guide unit 2 furthermore comprises a support plate 24 permanently connected with the housing 3, such support plate 24 Preferably being integrally connected with the housing 3. It more particularly constitutes an extension, running in parallelism to the depth direction of the slot 13, of the housing section flanking the slot 13. This means that the support plate 24 is on the same longitudinal side of the housing 3 as the slot 13.

Figure 2:
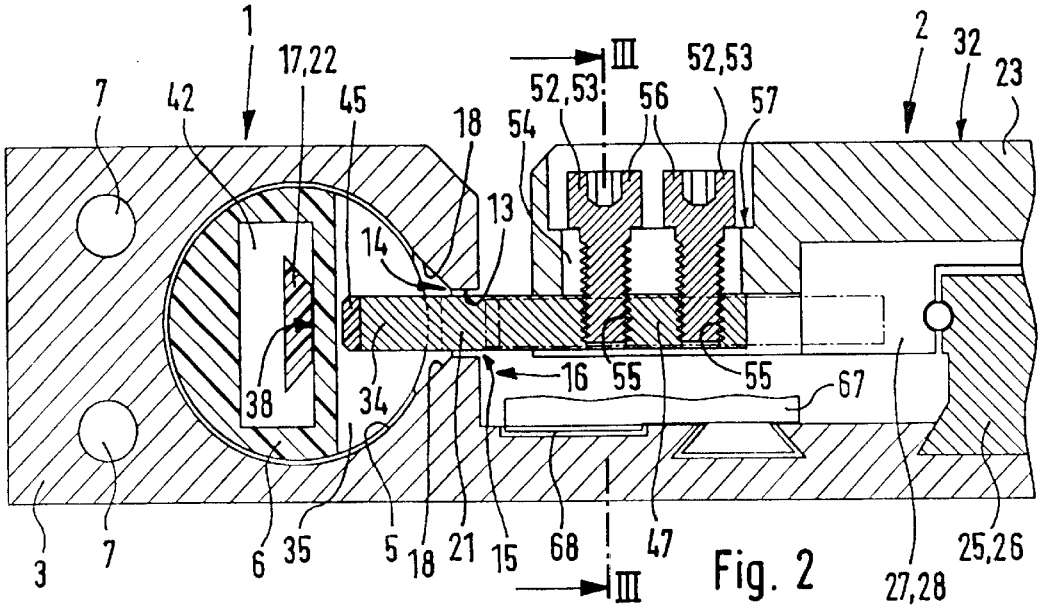
FIG. 2 is a cross sectional view taken through the linear drive of FIG. 1 on the section line II—II.
Figure 3:
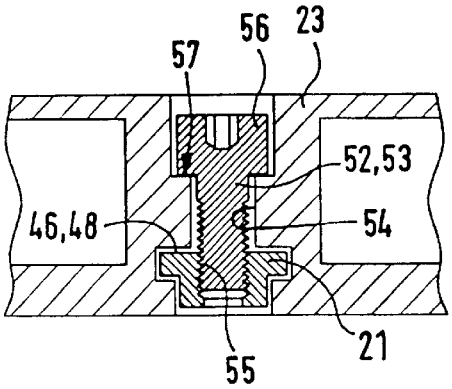
FIG. 3 is a longitudinal section taken through the linear drive of FIG. 1 on the section line III—III in FIG. 2.

A longitudinal guide 25 extending in parallelism to the longitudinal axis of the housing 3, is provided on the support plate 24. This guide 25 is preferably so placed that the outer opening 15 of the slot 13 is turned toward it. In the illustrated working embodiment the longitudinal guide 25 comprises a guide rail 26 firmly connected with the support plate 24, said guide rail 26 being more especially attached to the support plate 24 without using screws, for instance by swaging using rollers or by molding or casting in an integral fashion. It is mounted on that side of the support plate 24, on which the longitudinal slot 13 is also to be found. The longitudinal guide 25 is aligned to be at a distance from the housing 3 and carries the above mentioned slide 23. In this respect guide means 27 on the slide cooperate with the longitudinal guide 25 in such a manner that the slide 23 is able to run along, and is guided by, the longitudinal guide 25, and the longitudinal guide 25 is able to take up any transverse forces, acting in either direction, which may impinge on the slide 23. The longitudinal guide 25 and the guide means 27 on the slide may be a plain bearing type of guide or may involve the use of anti-friction rolling bearing elements. In this case the guide means 27 on the slide may have rail-like guide modules 28 more especially attached to the bottom side of the slide 23, which flank the guide rail 26 on opposite longitudinal sides. The slide 23 generally straddles the longitudinal guide 25, it having a first support face 32 facing away from the support plate 24, which support face does preferably not stand proud of the housing 3 so that there is the flat configuration seen in FIG. 2. Objects or loads to be moved can be attached by suitable attachment means 33 to the support face 32. In the embodiment of the invention a second support face 32' present on the longitudinal side of the slide 23 opposite to the housing 3 alternatively or in addition renders possible the attachment of components to be shifted.

Owing to entraining member 31 already mentioned the slide 23 is so coupled with the drive part 6 that a transmission of axially directed drive forces is possible. The drive part 6, the entraining member 21 and the slide 23 together hence constitute a kinematic unit, which may be displaced by the action on the drive part 6 in a uniform manner linearly in the longitudinal direction 4. In this respect the entraining connection is preferably so designed that apart from the above mentioned axial forces no other forces are able to be transmitted, something permitting certain relative movements between the slide 23 and the drive part 6, which for example are due to lack of exact parallelism between the longitudinal motion of the drive part 6 and of the slide 23.

The entraining member 21 is fixedly connected to the slide 23. An integral design would be possible, but however for simplification of assembly a separate structure and a releasable firm connection between the two parts is to be recommended.

The entraining member 21 is in the embodiment of FIGS. 1 through 4 designed in the form of a straight finger-like component, which may be produced relatively simply. The entraining member 21 employed in the embodiment of FIG. 5 also possesses a generally lug-like longitudinal configuration, but however is cranked or stepped more particularly several times at several points along its length for reasons later to be explained.

In both cases the entraining member 21 is so designed that, as seen in plan view looking toward the slide 23 as in FIG. 1, it extends from the slide 23 firstly like a finger toward the adjoining housing 3, it having a relatively slim entraining finger 34 extending through the longitudinal slot 13 and having its free end, which points away from the slide 23, fitting into a receiving socket 35 provided on the drive part 6. This receiving socket 3 is, in the present working example, constituted by groove-like recess extending only over part of the periphery of the drive part 6, such recess being open toward the longitudinal slot 13 and being delimited by axially oriented faces, which are turned toward one another and are set at a certain distance apart, such faces being termed force transmission faces 36.

The external faces 37, which are within the receiving socket 35 and are axially opposite each other, of the entraining finger 34 are respectively turned toward one of the force transmission faces 36 and make contact therewith so that the entraining finger 34 is supported and held in a moving manner in the receiving socket 35 axially free of play. Dependent on the direction of motion of the drive part 6 the one or the other force transmitting face 36 will against on the facing external face 37 of the entraining member 34 and will consequently transmit an axially orientated drive force to the entraining member 21 and the slide 23 solid with it.

The lifting of the sealing tape 17 clear of the sealing faces 18 on passage of the drive part 6 is caused by a guide face arrangement 38, which is provided directly on the drive part 6 and is so aligned that it is turned away from the longitudinal slot 13. In the illustrated working embodiment the guide face arrangement 38 is a component of the wall or, respectively, inner face of a guide channel 42, extending for at least a part of its length, said sealing tape 17 extending through it.

The entraining member 21 is so designed and so arranged that the free end directed away from the slide 23, of the entraining finger 34 of the member 21 points toward the sealing tape 17 extending through the drive part 6 and the entraining finger 34 ends short of the sealing tape assembly 22 moved clear of the longitudinal slot 13. Accordingly in the working example the radial depth of the receiving socket 35 is so selected that it terminates before reaching the guide channel 42. In principle it would be possible for the radial depth of the receiving socket 35 to be so selected that it intersects the guide channel 42 from the longitudinal side and merges with it. In order to be certain of preventing any direct contact between the entraining finger 34 and the lifted part 22 of the sealing tape despite any relative motion between the entraining member 21 and the drive part 6, which could not be stopped by cooperation between the entraining finger 34 and the receiving socket 35, in the working example of the invention a partition 43 is provided between the receiving socket 35 and the guide channel 42, such partition practically constituting the floor of the receiving socket 35.

Since the entraining member 21 does not include any components of the guide face arrangement 38, it may be fitted and removed without any problems as required while the drive unit 1 is fully functional. The open side of the receiving socket 35, which is on the inside radially opposite the longitudinal slot 13, is accessible at all to times through the longitudinal slot. The entraining finger 34 may readily be coupled with the receiving socket 3 simply by plugging it in.

Figure 4:
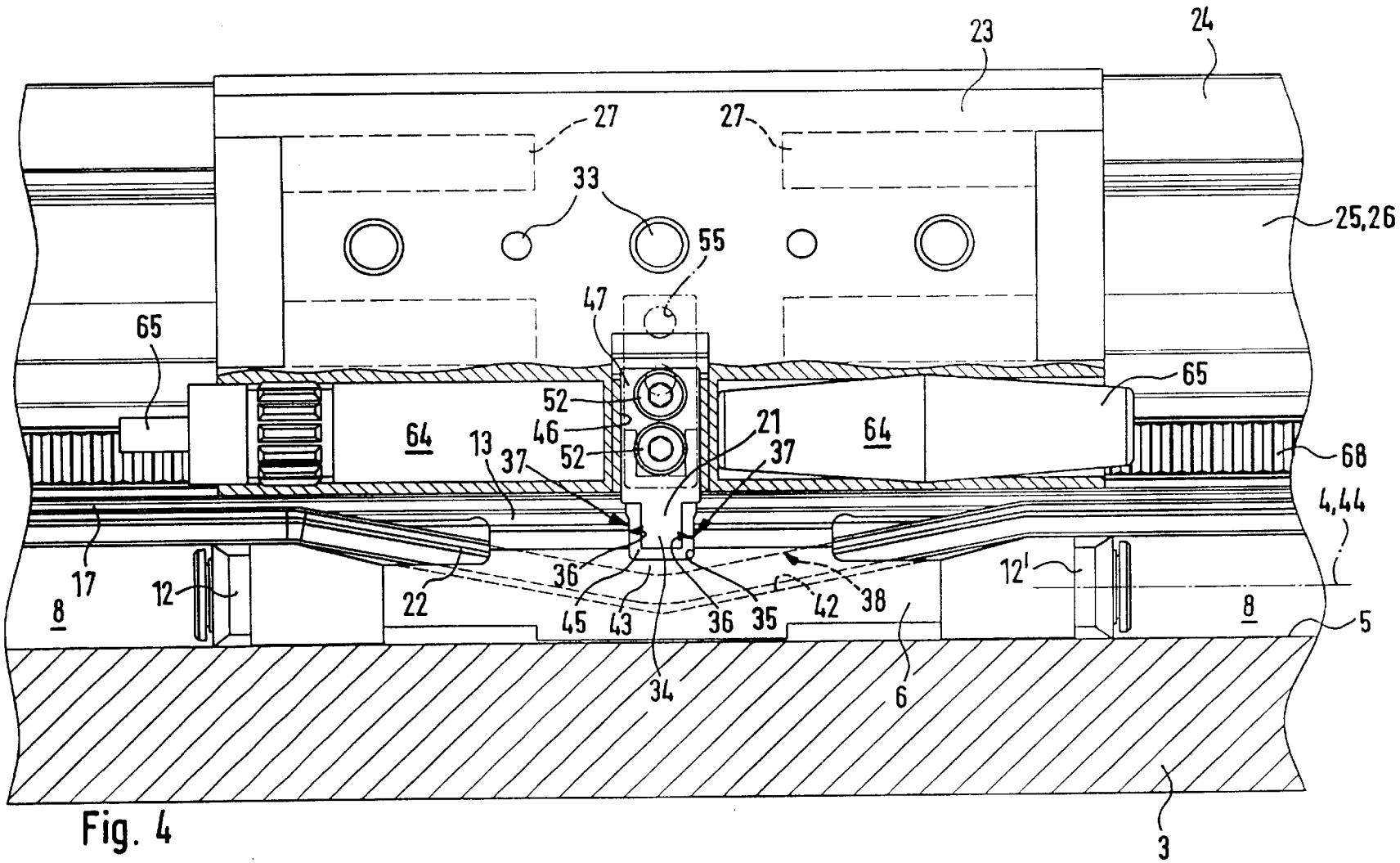
FIG. 4 is a plan view of the linear drive of FIG. 1 adjacent to the slide, partly broken away.

As shown in FIG. 4 the entraining finger 34 preferably comes to an end short of the longitudinally extending center axis of the drive part 6. This means that the cross section of the drive part 6 is only reduced to an extremely small extent and its strength is not even affected if all the drive part 6 is, as in the present case, made of synthetic resin material, the guide face arrangement 38 being, if desired, an integral portion of the drive part 6.

In order to provide an axially play-free connection precluding jerks between the entraining finer 34 and the drive part 6, which nevertheless permits a slight relative movement in all directions between the entraining finger 34 and the drive part 6, in the embodiment of the invention there is a provision such that the entraining finger 34 cooperates by the intermediary of an elastomeric intermediate layer 45 with the force transmission faces 36 preferably formed as an integral component of the drive part 6. The intermediate layer 45 may, as indicated in FIG. 4, be fitted like a cap on the free end of the entraining finger 34 so that its free terminal face and the axially opposite side faces of the entraining finger 34 are covered. The external faces 37 cooperating with the force transmission faces 36 are in this case provided on the intermediate layer 45 so that the structure is able to yield somewhat and the intermediate layer may function as a buffer means. The intermediate layer 45 may for instance be bonded or clipped onto the entraining finger 34.

In order to simplify coupling and uncoupling between the slide 23 and the drive part 6 as far as possible, the entraining member 21 is arranged in such an adjustable fashion on the slide 23 in the embodiment of FIGS. 1 through 4 that it may be positioned selectively in an extended setting fitting right through the longitudinal slot 13 into the receiving socket 35 and a retracted setting clear of the longitudinal slot 13 outside the housing 3. The extended position is indicated FIGS. 2 and 4 in full lines, whereas the retracted one is indicated in chained lines. Thus it is possible, with the drive unit 1 fully fitted and with the slide 23 mounted on the longitudinal guide 25, to move the entraining member 21, which has been preliminarily fixed on the slide 23, into and out of engagement with the receiving socket 35. Therefore it is more particularly possible to temporarily remove the slide 32 for any servicing operations which may be necessary without having to manipulate the drive unit 1.

The adjustable mounting means for the entraining member 21 is produced in the working example since a linear guide 46 is provided on the slide 23, such guide extending at a right angle to its direction of motion, and the entraining member 21 has a rear terminal part 47, opposite to the entraining finger 34, running in a longitudinally sliding manner in the linear guide 46. The linear guide 46 may, as illustrated, be in the form of a groove-like recess, into which the entraining member 21 extends to a greater or lesser extent in accordance with the instantaneous position. In this respect it is convenient to provide a design such as to ensure that the entraining member 21 is held in a tethered or unlosable manner even when it is yet not done up tight. In the working example the linear guide 46 is constituted by an undercut guide groove 48 which is open toward the bottom side of the slide 23 and which receives a complementary cross section of the entraining member 21 with a mutual fit and which is open toward the longitudinal slot 13 at the same level as it.

Moreover securing means 52 are present, with which the entraining member 21 may be locked immovably in its instantaneous position on the slide 23. The securing means 52 are in the working example constituted by screw means and comprise, for instance, two screws 53, which from the first support face 32 extend through a linear slot 54 extending in parallelism to the linear guide 46, same being screwed into tapped holes 55 in the entraining member 21 and having their heads 56 abutting against a ledge 57 delimiting the linear slot 54. The ledge 57 is preferably made with such a depth in the slide 23 that the heads 56 of the screws 53 assume a lower position in the slide 23 than the first support face 32.

When the screws 53 are removed it is possible for the entraining member 21 to be steplessly positioned in the length direction of the linear guide 46 and consequently in the depth direction of the longitudinal slot 13 as may be desired. To set the function chosen the screws 53 are driven home tight so that the entraining member 21 is braced in the guide 26.

In the case of the working embodiment there is the possibility of positioning the entraining member 21 even if only the screw 53 which is further from the housing 3, is completely removed. The other screw only has to be loosened, following which from the first support face 32 the entraining member 21 may be readily positioned by grasping the associated head 56. The threaded shank of the respective screw 53 is then shifted in the longitudinal direction of the linear slot 54.

The stepless setting of the entraining member 21 may be performed individually, allowing for any manufacturing inaccuracies, to take into account the distance between the slide 23 and the drive part 6.

Figure 5:
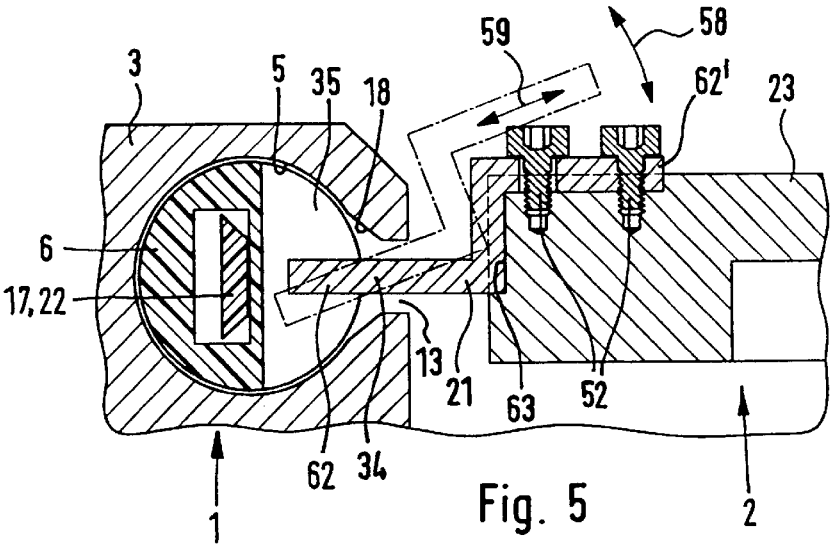
FIG. 5 is a representation generally similar to that of FIG. 2 as a modification of the linear drive with an altered design of the entraining member.

In the case of the alternative design illustrated in FIG. 5 the entraining member 21 has such a configuration that after installation of the drive part 6 and the slide 23 using a combined plugging and pivoting movement the member may be introduced through the longitudinal slot 13 into the receiving socket 35 and simultaneously may be coupled with the slide 23. The pivoting motion is indicated by a double arrow 8 and the plugging motion by a double arrow 59. Again securing means 52 are provided for attachment of the entraining member 21 on the slide 23. A particularly convenient feature is that the entraining member 21 is provided with a doubly cranked longitudinal form so that two mutually parallel terminal sections 62 and 62' are produced, of which one constitutes the entraining finger 34, whereas the other one may be engaged by the securing means 52. For locking in position it is possible for the entraining member 21 to extend from the slide 23 into a suitable seat 63.

The linear drive furthermore possesses two shock absorbers 64 secured to the slide 23, whose dampening portions 65 extend axially past the slide 23. They are respectively axially opposite to an abutment part 66 secured to the housing and preferably able to be adjusted axially, the holder 67 serving for fixation in relation to the housing, being able to cooperate with teeth 68 provided on the support plate 24 in order to provide for positively interlocking engagement and a secure holding action even in the case of a heavy impact.

What is claimed is:

1. A linear drive comprising an elongated housing, whose interior space contains a drive part adapted to move in the longitudinal direction and furthermore has a longitudinal slot, which is provided with a sealing tape extending in the interior space, said tape being lifted clear of the longitudinal slot locally at the drive part in accordance with longitudinal movement of same by at least one guide face arrangement, said face arrangement facing away from said longitudinal slot, a longitudinal guide which is arranged outside the interior space and extend in parallelism to the same, a slide guided on the longitudinal guide for movement in the longitudinal direction, and an entraining member, which is secured to the slide, extends through the longitudinal slot to fit into a receiving socket open toward the longitudinal side of the drive part where it bears on axially aligned force transmitting faces, wherein the guide face arrangement is provided on the drive part and furthermore the part of the entraining member fitting into the receiving socket is in the form of an entraining finger having a free end thereof directed toward the sealing tape, such finger terminating short of the sealing tape section moved clear of the longitudinal slot.

2. The linear drive as set forth in claim 1, wherein the sealing tape extends through a guide channel formed in the drive part, a wall of such channel constituting at least a part of the guide face arrangement, such channel extending past on the side, which is opposite to the longitudinal slot, of the receiving socket.

3. The linear drive as set forth in claim 2, comprising a partition extending between the receiving socket and the guide channel.

4. The linear drive as set forth in claim 1, wherein the entraining finger terminates short of the longitudinally extending center axis of the drive part.

5. The linear drive as set forth in claim 1, wherein the receiving socket is constituted by a groove-like recess extending for only a part of the periphery of the drive part.

6. The linear drive as set forth in claim 1, wherein the entraining finger cooperates with the force transmission faces by the intermediary of an elastomeric intermediate layer.

7. The linear drive as set forth in claim 6, wherein the layer is mounted on the free end of the entraining finger like a cap.

8. The linear drive as set forth in claim 1, wherein said drive part is manufactured of synthetic resin material and possesses an integrally formed guide face arrangement.

9. The linear drive as set forth in claim 1, wherein the entraining member is generally in the form of a straight, finger-like component.

10. The linear drive as set forth in claim 1, wherein the entraining member is secured to the slide in a releasable manner.

11. The linear drive as set forth in claim 10, wherein the entraining member possesses such a configuration that with the drive part and the slide already fitted it can be introduced by plugging and pivoting from the outside through the longitudinal slot into the receiving socket and simultaneously mounted in the socket.

12. The linear drive as set forth in claim 11, wherein the entraining part has a stepped or cranked longitudinal form.

13. The linear drive as set forth in claim 1, wherein the entraining member is so adjustably mounted on the slide that with the slide borne on the longitudinal guide it can be selectively positioned in an extended setting fitting through the longitudinal slot into the receiving socket and a retracted setting outside the longitudinal slot.

14. The linear drive as set forth in claim 13, wherein the entraining member is borne on the slide in a sliding fashion in order to permit a more particularly stepless positioning in the depth direction of the longitudinal slot.

15. The linear drive as set forth in claim 1, wherein the longitudinal guide is provided on a support plate connected with the housing and is opposite to that longitudinal side of the housing, which has the longitudinal slot.

16. The linear drive as set forth in claim 15, wherein the support plate and the housing are made integrally.

17. The linear drive as set forth in claim 1, comprising at least one shock absorber secured to the slide and an abutment part arranged in the extension of the shock absorber, said abutment part being connected with the housing.

18. The linear drive as set forth in claim 1 designed for fluid power operation, said drive part being constituted by a piston dividing the interior space in a sealing manner into two working spaces adapted to be put under fluid pressure.

* * * * *

UNITED STATES PATENT AND TRADEMARK OFFICE

CERTIFICATE OF CORRECTION

PATENT NO. : 6,338,294 B1
DATED : January 15, 2002
INVENTOR(S) : Wagner et al.

It is certified that error appears in the above-identified patent and that said Letters Patent is hereby corrected as shown below:

Column 4,
Line 18, now reads “working spaces 8 and 8’ lying” should read -- working spaces 8 lying --;
Line 52, now reads “through the slot 21” should read -- through the slot 13 --;

Column 5,
Line 13, now reads “guide 25 and the” should read -- guide 25. The --;
Line 30, now reads “entraining member 31” should read -- entraining member 21 --;

Column 6,
Line 50, now reads “accessible at all to times” should read -- accessible at all times --;

Column 8,
Line 53, now reads “toward the longitudinal side” should read -- toward a longitudinal side --;
Line 56, now reads “furthermore the part of” should read -- furthermore a part of --; and Column 9,
Line 11, now reads “with the force transmission” should read -- with the force transmitting --.

Signed and Sealed this

Tenth Day of September, 2002

*Attest:*

*Attesting Officer*

JAMES E. ROGAN
*Director of the United States Patent and Trademark Office*